US005236725A

United States Patent [19]

McCormack et al.

[11] Patent Number: 5,236,725

[45] Date of Patent: Aug. 17, 1993

[54] CANDY PACKAGE AND ATTACHMENT MEANS THEREFOR

[75] Inventors: Beatrice McCormack; Donald H. Bravaldo, Jr., both of Albany, Ga.

[73] Assignee: Bob's Candies, Inc., Albany, Ga.

[21] Appl. No.: 794,238

[22] Filed: Nov. 19, 1991

[51] Int. Cl.[5] ..... B65D 85/00

[52] U.S. Cl. ..... 426/106; 426/104; 426/112; 426/132; 40/666

[58] Field of Search ..... 426/104, 132, 106, 112; 40/666, 124.1, 637

[56] References Cited

U.S. PATENT DOCUMENTS

| | | | |
|---|---|---|---|
| 973,731 | 10/1910 | Watkins | 40/658 |
| 1,238,110 | 8/1917 | Coolidge | 426/104 |
| 1,468,743 | 9/1923 | Porter | 426/104 |
| 1,540,320 | 10/1923 | Everett et al. | 40/666 |
| 2,861,318 | 11/1958 | Fernberg | 24/562 |
| 3,332,787 | 7/1967 | Wagenheim | 426/104 |
| 3,905,570 | 9/1975 | Nieuwveld | 248/71 |
| 3,977,104 | 8/1976 | Stupar | 40/299 |
| 4,203,516 | 5/1980 | Stonoga et al. | 426/104 |
| 4,268,986 | 5/1981 | Piana | 40/661 |
| 4,292,749 | 10/1981 | Thomas | 40/666 |
| 4,563,796 | 1/1986 | Kettlestrings | 40/666 |
| 5,096,058 | 3/1992 | Juravin et al. | 40/124.1 |

*Primary Examiner*—R. B. Penland

*Attorney, Agent, or Firm*—Mason, Fenwick & Lawrence

[57] ABSTRACT

A stick candy package includes a transparent plastic clip having stiff arms embracing the candy with a tag and bow being attached to the attachment clip member for ornamental effect. In a first embodiment the tag and bow are attached by adhesive means to the attachment clip while in the second embodiment they are attached to the attachment clip by a twist-tie member embracing a length of ornamental ribbon arranged to have the appearance of a bow but which has not been pre-tied.

10 Claims, 2 Drawing Sheets

CANDY PACKAGE AND ATTACHMENT MEANS THEREFOR

BACKGROUND OF THE INVENTION

The present invention is in the field of packaging and is more specifically directed to the field of candy packaging of stick candy of the type normally provided in transparent wrap. Even more specifically, the present invention is directed to a candy package comprising a candy body provided in a variety of shapes such as cylindrical rods, canes and wreath shapes all of well-known type.

Additionally, the present invention is directed to unique attachment means for permitting the attachment of a bow and/or a tag or card to stick candy in any of the aforementioned shapes for enhancing the ornamental appearance of same and for providing a candy package which can easily be used as a small gift and personalized by the application of a message, the name of a recipient and the name of the person making the gift.

It has been well known practice in the candy industry to provide stick candy packages in various forms such as wreaths, canes and linear rod shapes with bows and a card attached thereto. The practice in the past has been to attach the bow and the card by the use of a twist-tie of the type comprising a paper or plastic coated wire of the well-known construction which is used for a multitude of purposes. Unfortunately, the use of twist-tie devices for attaching bows and cards and similar items directly to stick candy is a relatively complicated time-consuming procedure requiring expensive manual labor which increases the cost of the finished product. Moreover, the resultant product is not totally satisfactory in that the bow and the card frequently become disassociated from the stick candy either due to the unwinding of the twist-tie or slippage from over the end of the candy.

A large number of clip-type attachment devices have been previously proposed in unrelated arts to the candy industry such as evidenced by U.S. Pat. Nos. 4,292,749; 4,268,986; 3,977,104; 3,905,570; 2,861,318; 1,540,320 and 973,731. For example, the Thomas U.S. Pat. No. 4,292,749 discloses a clip for attaching a coupon to a grocery cart; the Piana U.S. Pat. No. 4,268,986 discloses an identification device in which information is provided with the device being capable of being clipped to a variety of objects none of which is in the candy field; the Stupar U.S. Pat. No. 3,977,104 discloses an identification device including a clip attachable to ignition wires of an automobile engine; the Nleuwveld U.S. Pat. No. 3,905,570 discloses a fastening device formed of a plastic having an end mountable in a hole of appropriate size for retention; the Fernberg U.S. Pat. No. 2,861,318 discloses a variety of cylindrical fasteners usable for connection to automobile seat components for securing flexible materials thereto; the Everett, et al U.S. Pat. No. 1,540,320 discloses identification devices clipable to wire conduits and the Watkins U.S. Pat. No. 973,731 discloses a card holding device which is attached to a card clip for mounting same on a bottle or the like.

None of the aforementioned unrelated prior art or other prior art known to applicants presents or suggests a solution to the problems of connecting and maintaining ornamental bows and associated cards on stick candy.

SUMMARY OF THE INVENTION

It is the primary object of the present invention to provide a new and improved candy package including a stick candy body and ornamental bow and/or a card with the bow and card components being attached to the stick candy so as not to have a tendency to become disassociated from the stick candy body.

A further object of the present invention is a provision of a new and improved attachment clip means for permitting the attachment to stick candy of an ornamental bow and/or a card.

Other objects of the present invention will become apparent from the following detailed description of the invention.

Achievement of the foregoing objects is enabled by the first embodiment of the invention which comprises an attachment clip formed of clear, transparent plastic and comprising a base member from which first and second curved clamp arms extending in facing manner with the clamp arms being shaped and dimensioned so that they can be snapped over a stick candy body for retention thereon. Normally, the stick candy will be enclosed within a transparent wrapping such as a shrink-wrap plastic material or cellophane.

The attachment clip includes a base portion from which the clip arms unitarily extend with the base having a shallow trough in which adhesive is received with a card having an aperture being positioned on the adhesive which protrudes through the aperture to engage the bottom of a previously tied ribbon bow so that the previously tied ribbon bow and the card are held in position on the base of the clip member by the adhesive. The clip member is snapped over a hard candy stick having a cylindrical outer surface of well-known conventional configuration and remains in position with there being little likelihood of it becoming disengaged from the candy stick.

The second, and preferred, embodiment of the invention employs the same identical clip attachment as previously described but differs in that adhesive is not used for securing the card and the ribbon to the clip attachment. Moreover, the bow need not be previously tied for use with the second embodiment in that a twist-tie is looped around folded ribbon members to engage and hold the central portion of the folded ribbon members so that they are in a form having the appearance of a bow with the center transverse bow portion comprising the exposed surface of the twist-tie which appears to be part of the "bow". The ends of the twist-tie extend through the opening in the card and are wrapped around the base member of the clip attachment in the space between the clamp arms so as to snugly retain the "bow" and the card on the clip attachment. The clip attachment is mountable on a candy stick, cane or the like in the same manner as the first embodiment.

DESCRIPTION OF THE PREFERRED EMBODIMENT

Figure 6:
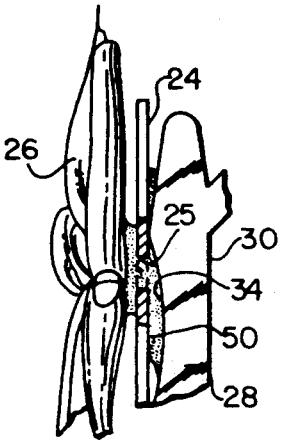
FIG. 6 is an enlargement of the encircled portion of FIG. 5.

The first embodiment of the invention, generally designated 20, consists of three main components; namely, an attachment clip 22 formed of clear plastic such as propionate or equivalent, a conventional card or tag 24 having an aperture 25 (FIG. 6) near one end and a pre-tied ribbon bow 26.

The attachment clip 22 includes a rectangular base member 28 having an inner surface 30 and an outer surface 32. The outer surface includes a shallow indentation 34 in the form of a trough extending between the first and second side edges 36 and 38 of the attachment clip.

Figure 1:
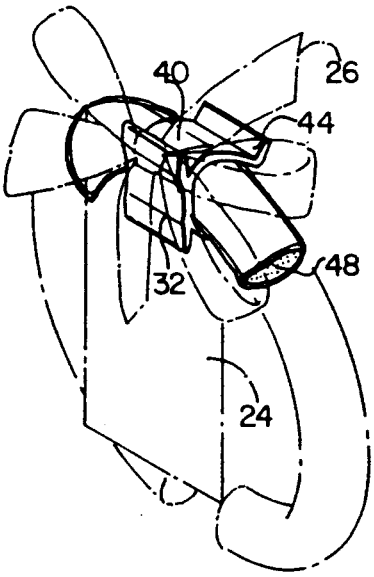
FIG. 1 is a frontal perspective view of a first embodiment of the invention in which the stick candy and the card are illustrated in phantom so as to better enable illustration of the attachment clip component of the disclosed embodiment.
Figure 2:
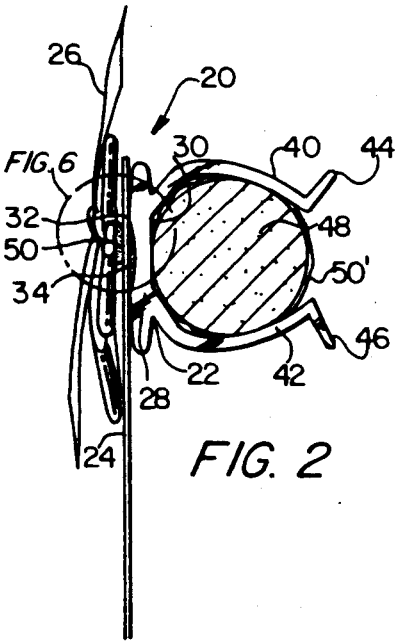
FIG. 2 is a side elevation view of the preferred embodiment as attached to a hard candy stick which is shown in cross-section.
Figure 3:
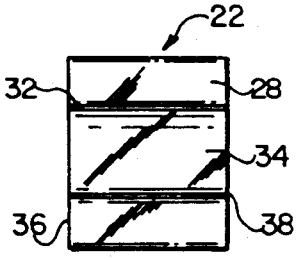
FIG. 3 is a front elevation view of the attachment clip of the preferred embodiment.
Figure 4:
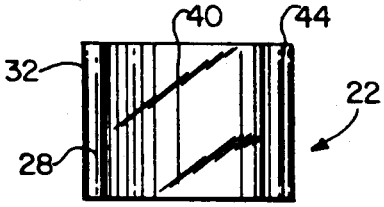
FIG. 4 is a top plan view of the attachment clip of the preferred embodiment.
Figure 5:
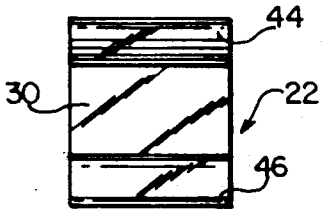
FIG. 5 is a rear elevation view of the attachment clip of the preferred embodiment.

Attachment clip 22 additionally includes first and second clip arms 40 and 42 which extend unitarily outward from the base member 28 and have finger flanges 44 and 46 at their outer ends. The material of which the attachment clip 22 is formed is sufficiently resilient to permit the first or second clip arms 40 and 42 to snap over a body of circular cross-section of stick candy (hard candy) 48 as best shown in FIGS. 1 and 2. The body of stick candy as illustrated is in the form of a wreath; however, it should be understood that the stick candy could also equally easily be a linear cylindrical stick, a cane shape or other shape of the type having a circular cross section as illustrated in FIG. 2. The outer surface of the stick candy is enclosed within shrink wrap material 50' which can be of the type sold by Reynolds Metals of Grottoes, Va. under the Trademark Reynolon 2044 or equivalent; similarly, the cover can simply be cellophane if desired.

The package assembly is formed by providing a quantity 50 of adhesive, such as hot-melt glue in the indentation 34 of the base member 28 with the card 24 being positioned so that the adhesive 50 protrudes outwardly through the opening 25 in the card to engage the lower surface of the ribbon forming bow 26 so that upon hardening of the adhesive, the entire assembly is held in position on the clip member in an obvious manner as shown in FIG. 2.

When the package assembly is positioned on the candy stick 48, the clip arms 40 and 42 snap over and snugly engage the outer surface of the wrapping enclosing the candy so as to be retained thereon with there being little chance of dislodgement.

Figure 7:
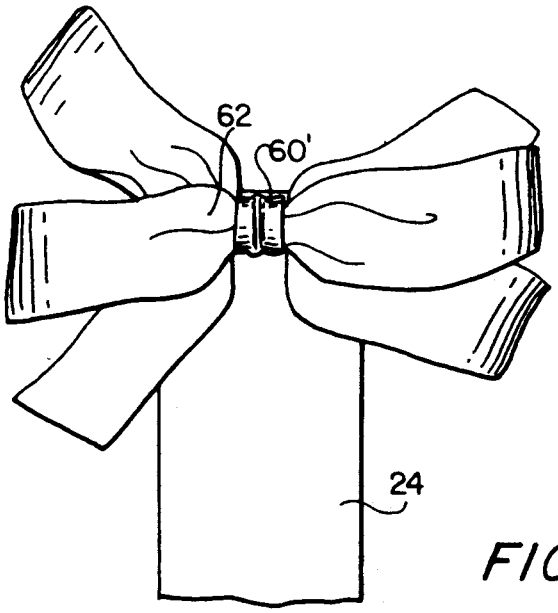
FIG. 7 is a front elevation view of the preferred embodiment of the invention.
Figure 8:
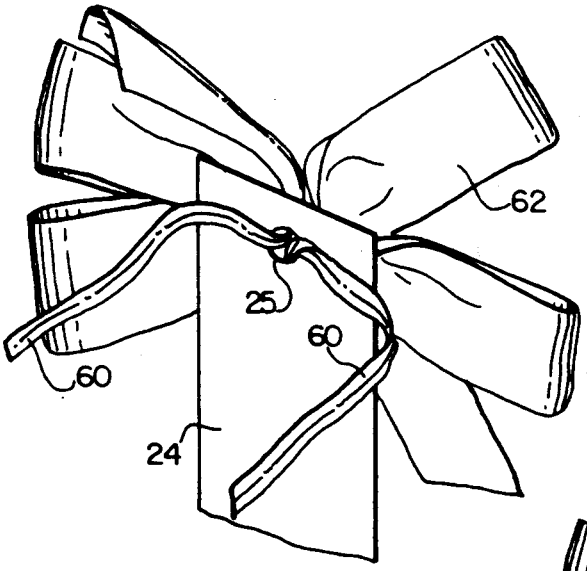
FIG. 8 is a rear perspective view of the card and ribbon components of the preferred embodiment following an initial step in the assembly of the preferred embodiment.
Figure 9:
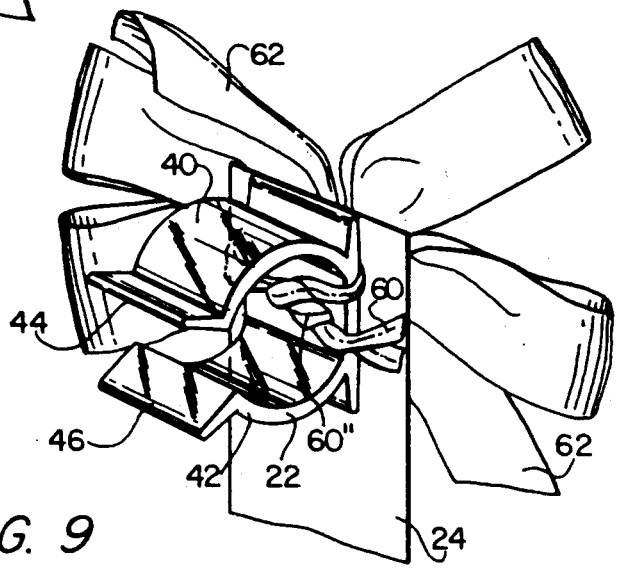
FIG. 9 is a rear perspective view of the preferred embodiment.

The second, and preferred, embodiment of the invention is illustrated in FIG. 7, 8 and 9 and includes an attachment clip 22 which is identical to the previously described attachment clip described with respect to the first embodiment and a card or tag 24 that is also identical to the card or tag 24 described with respect to the first embodiment. However, the second embodiment differs from the first embodiment in that it does not employ adhesive for attaching the card and a previously tied bow to the attachment clip. More specifically, the second, and preferred, embodiment employs a conventional twist-tie member 60 formed of a paper or plastic web having a metal wire embedded axially along its length which retains a quantity of ribbon material 62 folded and arranged to resemble a bow by virtue of the fact that the central portion 60' of the twist-tie 60 snugly encircles the waist or center of the ribbon material somewhat like a belt so that the ribbon material which is the same color as twist-tie 60 so that the ribbon and central portion 60' coact to provide the appearance of a bow. The free ends of the twist-tie 60 extend through the opening 25 in the card or bow and are then twisted together as shown at 60'' in FIG. 9. The attachment clip is then easily snapped on to the stick candy and retained thereon in the exact same manner as the attachment clip of the first embodiment.

Consequently, the second, or preferred, embodiment obtains the same desirable results as the first embodiment while also avoiding the additional cost of pre-tying the bow and the expense of using adhesive and the necessary equipment for applying same. Additionally, it is usable with plastic or other ribbon materials which may be difficult to bond with adhesive.

It should be understood that the period and scope of the present invention is not limited to the disclosed embodiment but is limited solely by the pending claims. Consequently, in numerous modifications and use of equivalent structures as will occur to those skilled in the art will not avoid the coverage of the claims.

I claim:

1. A candy package comprising:

(a) a wrapped candy body having an outer surface of generally circular shape when viewed in cross-section;

(b) a clip member comprising a base member having an inner surface and an outer surface, said inner surface being tangentially positioned relative to the outer surface of said candy body, first and second clip arms extending outwardly from said base member partially around said candy body to clampingly embrace said candy body to removably retain said clip member on said candy body;

(c) tag means attached to the outer surface of said base member and (d) ornamental ribbon means in the shape of a bow attached to said tag means, wherein said tag means in between said ribbon means in the shape of a bow and said base member.

2. The candy package of claim 1 wherein said clip member is formed of plastic material.

3. The candy package of claim 2 wherein said ribbon means in the shape of a bow is held in position on said base member by twist-tie means.

4. The candy package of claims 1 wherein said tag means includes an aperture extending through said tag means and further including a twist-tie member having first and second end portions extending through said aperture and a central portion looped around said ribbon means and around said base member with said twist-tie end portions being wrapped and twisted together for retaining both said tag and said ribbon means on said clip member.

5. The candy package of claim 1 wherein said ribbon means in the shape of a bow comprises a pre-tied bow and said tag means includes an aperture extending through said tag means and further including a body of cured adhesive extending through said aperture for bonding both said tag and said ornamental bow to said base member.

6. The candy package of claim 5 additionally including first and second outwardly flaring finger flanges respectively provided on said first and second clip arms at the outer end of said clip arms spaced from said base member.

7. The candy package of claim 6 wherein said base member includes a shallow indentation in its outer surface in which said adhesive is partially positioned.

8. The candy package of claim 7 wherein said indentation is a trough extending parallel to the axis of said circular shape.

9. The candy package of claim 8 wherein said clip member is transparent.

10. The candy package of claim 9 wherein said base member has upper and lower edge terminations and said clip arms extend unitarily from said base member at locations spaced inwardly from said upper and lower edge terminations.

* * * * *